US011788484B2

(12) United States Patent
Niemeyer et al.

(10) Patent No.: US 11,788,484 B2
(45) Date of Patent: Oct. 17, 2023

(54) METHOD FOR THE MODEL-BASED OPEN-LOOP AND CLOSED-LOOP CONTROL OF AN INTERNAL COMBUSTION ENGINE

(71) Applicant: Rolls-Royce Solutions GmbH, Friedrichshafen (DE)

(72) Inventors: Jens Niemeyer, Friedrichshafen (DE); Roman Geiselhart, Blaustein (DE); Knut Graichen, Heroldsberg (DE); Daniel Bergmann, Bad Waldsee (DE)

(73) Assignee: Rolls-Royce Solutions GmbH, Friedrichshafen (DE)

( * ) Notice: Subject to any disclaimer, the term of this patent is extended or adjusted under 35 U.S.C. 154(b) by 0 days.

(21) Appl. No.: 17/993,578

(22) Filed: Nov. 23, 2022

(65) Prior Publication Data

US 2023/0093283 A1 Mar. 23, 2023

Related U.S. Application Data

(63) Continuation of application No. PCT/EP2021/063945, filed on May 25, 2021.

(51) Int. Cl.
*F02D 41/14* (2006.01)
*F02D 41/30* (2006.01)

(52) U.S. Cl.
CPC ..... *F02D 41/1406* (2013.01); *F02D 41/1402* (2013.01); *F02D 41/3005* (2013.01); *F02D 2041/1433* (2013.01)

(58) Field of Classification Search
CPC ..... F02D 41/1406; F02D 41/3005; F02D 2041/1433
See application file for complete search history.

(56) References Cited

U.S. PATENT DOCUMENTS 10,550,786 B1 2/2020 Haskara et al.
10,975,795 B2 4/2021 Niemeyer et al.
(Continued)

FOREIGN PATENT DOCUMENTS

DE 10 2006 004 516 B3 3/2007
DE 10 2017 005 783 A1 12/2018
(Continued)

OTHER PUBLICATIONS

Niemeyer, DE 102017005783 A1, machine translation (Year: 2017).*
(Continued)

*Primary Examiner* — Hung Q Nguyen
*Assistant Examiner* — Mark L. Greene
(74) *Attorney, Agent, or Firm* — Taylor IP, P.C.

(57) ABSTRACT

A method for a model-based open-loop and closed-loop control of an internal combustion engine includes the steps of: calculating, by an optimizer, a pre-optimized quality measure based on an operating situation, wherein, in calculating the pre-optimized quality measure, a plurality of discrete manipulated variables having a plurality of discrete settings are interpreted as a plurality of continuous manipulated variables having a continuous settings range; quantizing the plurality of continuous manipulated variables, and the plurality of continuous manipulated variables are set as a plurality of new discrete manipulated variables (SG(new)) having a plurality of discrete settings; and calculating, by the optimizer, a post-optimized quality measure based on the plurality of new discrete manipulated variables and the operating situation of the internal combustion engine, and the post-optimized quality measure is set as critical for an operating point of the internal combustion engine by the optimizer.

5 Claims, 6 Drawing Sheets

(56) References Cited

U.S. PATENT DOCUMENTS

| | | | | |
|---|---|---|---|---|
| 11,156,183 | B2 | 10/2021 | Bergmann et al. | |
| 2011/0172897 | A1 | 7/2011 | Tsuzuki et al. | |
| 2016/0150488 | A1* | 5/2016 | Luo | H04W 52/265 370/328 |

FOREIGN PATENT DOCUMENTS

| | | | |
|---|---|---|---|
| DE | 10 2017 114 731 | A1 | 1/2019 |
| WO | 2018/234093 | A1 | 12/2018 |

OTHER PUBLICATIONS

"Model Predictive Trajectory Set Control with Adaptive Input Domain Discretization", Artemi Makaraw et al., Annual American Control Conference (ACC) Jun. 27-29, 2018. Wisconsin Center, Milwaukee, USA (7 pages).

International Search Report and Written Opinion dated Aug. 3, 2021 for International Application No. PCT/EP2021/063945 (15 pages).

* cited by examiner

METHOD FOR THE MODEL-BASED OPEN-LOOP AND CLOSED-LOOP CONTROL OF AN INTERNAL COMBUSTION ENGINE

CROSS REFERENCE TO RELATED APPLICATIONS

This is a continuation of PCT application no. PCT/EP2021/063945, entitled "METHOD FOR THE MODEL-BASED OPEN-LOOP AND CLOSED-LOOP CONTROL OF AN INTERNAL COMBUSTION ENGINE", filed May 25, 2021, which is incorporated herein by reference. PCT application no. PCT/EP2021/063945 claims priority to German patent application no. DE 10 2020 003 174.9, filed May 27, 2020, which is incorporated herein by reference.

BACKGROUND OF THE INVENTION

1. Field of the Invention

The present invention relates to a method for the model-based open-loop and closed-loop control of an internal combustion engine.

2. Description of the Related Art

The characteristics of an internal combustion engine are determined primarily via an engine control unit based on a performance requirement. Corresponding characteristic curves and engine characteristics are usually applied in the software of the engine control unit for this purpose. Using these, manipulated variables of the internal combustion engine are calculated from the performance requirement, for example, the start of injection and a required rail pressure. The characteristic curves/engine characteristics are populated with data by the manufacturer of the internal combustion engine on a test stand. However, the large number of these characteristic curves/engine characteristics and the correlation of the characteristic curves/engine characteristics among one another entail a high adjustment effort.

In practice, therefore, the attempt is made to reduce the adjustment effort through the use of mathematical models. Thus, DE 10 2006 004 516 B3 describes, for example, a Bayes network with probability tables in order to specify an injection quantity, and US 2011/0172897 A1 describes a method for the adaptation of the start of injection as well as the injection quantity via combustion models by way of neural networks. Since in this case trained data are mapped, these must first be learned in a test stand run.

A method is known from DE 10 2017 005 783 A1 for the model-based open-loop and closed-loop control of an internal combustion engine, in which the setpoint values for the injection system actuators are calculated via an internal combustion model and the setpoint values for the gas path actuators are calculated via a gas path model. Both the combustion model and the gas path model are based on Gaussian process models. From the setpoint values, an optimizer in turn determines a quality measure and predicts within a prediction horizon how the quality measure would develop in the case of a change of the setpoint values. If the best possible quality measure is calculated, then the optimizer sets the injection system setpoint values and the gas path setpoint values as critical for the operating point of the internal combustion engine.

In test stand tests, it has been shown that the inclusion of manipulated variables having discrete switching states in the previously described model-based method is not yet satisfactory. Manipulated variables having discrete switching states are understood to mean, for example, the connection of the second exhaust gas turbocharger during a sequential turbocharging, a cylinder bank switch-off, the activation of a pre-injection and post-injection and the opened and closed position of various valves. So-called branch and bound methods for optimal problem-solving in the case of discrete manipulated variables are very computationally-intensive, since, in the worst case, all combinatory possibilities of the discrete manipulated variables must be examined. The use thereof in an internal combustion engine quickly results in very complex structures, which are not representable on an engine control unit.

What is needed in the art is to improve the previously described model-based method with respect to the inclusion of manipulated variables.

SUMMARY OF THE INVENTION

The present invention relates to a method for the model-based open-loop and closed-loop control of an internal combustion engine, in which a quality measure is calculated by an optimizer and is set as critical for the operating point of the internal combustion engine. The present invention provides a method that is carried out in three steps. In the first step, the optimizer calculates a pre-optimized quality measure based on the operating situation, wherein the discrete manipulated variables having discrete settings are interpreted as continuous manipulated variables having a continuous settings range. The pre-optimized quality measure is an operand, i.e., it is not connected to the internal combustion engine. In the second step, these continuous manipulated variables are then quantized and set as new discrete manipulated variables having discrete settings. The quantization takes place based on switching thresholds in addition to hysteresis. Finally, a post-optimized quality measure is calculated based on the new discrete manipulated variables and of the operating situation of the internal combustion engine by the optimizer in the third step and is set as critical for the operating point of the internal combustion engine. In the calculation of the post-optimized quality measure, however, the new discrete manipulated variables are assumed to be fixed. In this respect, they no longer represent any degree of freedom for the optimization within the predicted horizon. The remaining continuous manipulated variables are re-optimized in such a way that the solution with respect to the fixed new manipulated variables is the best possible one.

Operating situation of the internal combustion engine is understood to mean both the external framework conditions, in particular, the emission limit values or the performance requirement, as well as the current operating point. Both the pre-optimized quality measure as well as the post-optimized quality measure are determined by calculating the injection system setpoint values for activating the injection system actuators, for example, the setpoint rail pressure, using the combustion model by measuring the gas path setpoint values for activating the gas path actuators using a gas path model and subsequently changing these setpoint values via the optimizer with the aim of a minimum finding.

The invention allows optimization tasks to be solved with partially value-continuous and partially value-discrete input variables in the case of limited computing capacity for the optimization method used. Instead of a parallel calculation of the manipulated variables, as is required for the implementation of branch and bound methods, the invention uses a serial methodology. Only in this way, it is possible to fully calculate the quality measure and the resulting values for the manipulated variables on an engine control unit.

BRIEF DESCRIPTION OF THE DRAWINGS

The above-mentioned and other features and advantages of this invention, and the manner of attaining them, will become more apparent and the invention will be better understood by reference to the following description of at least one embodiment of the invention taken in conjunction with the accompanying drawings, wherein.

Corresponding reference characters indicate corresponding parts throughout the several views. The exemplifications set out herein illustrate at least one embodiment of the invention, and such exemplifications are not to be construed as limiting the scope of the invention in any manner.

DETAILED DESCRIPTION OF THE INVENTION

Figure 1:
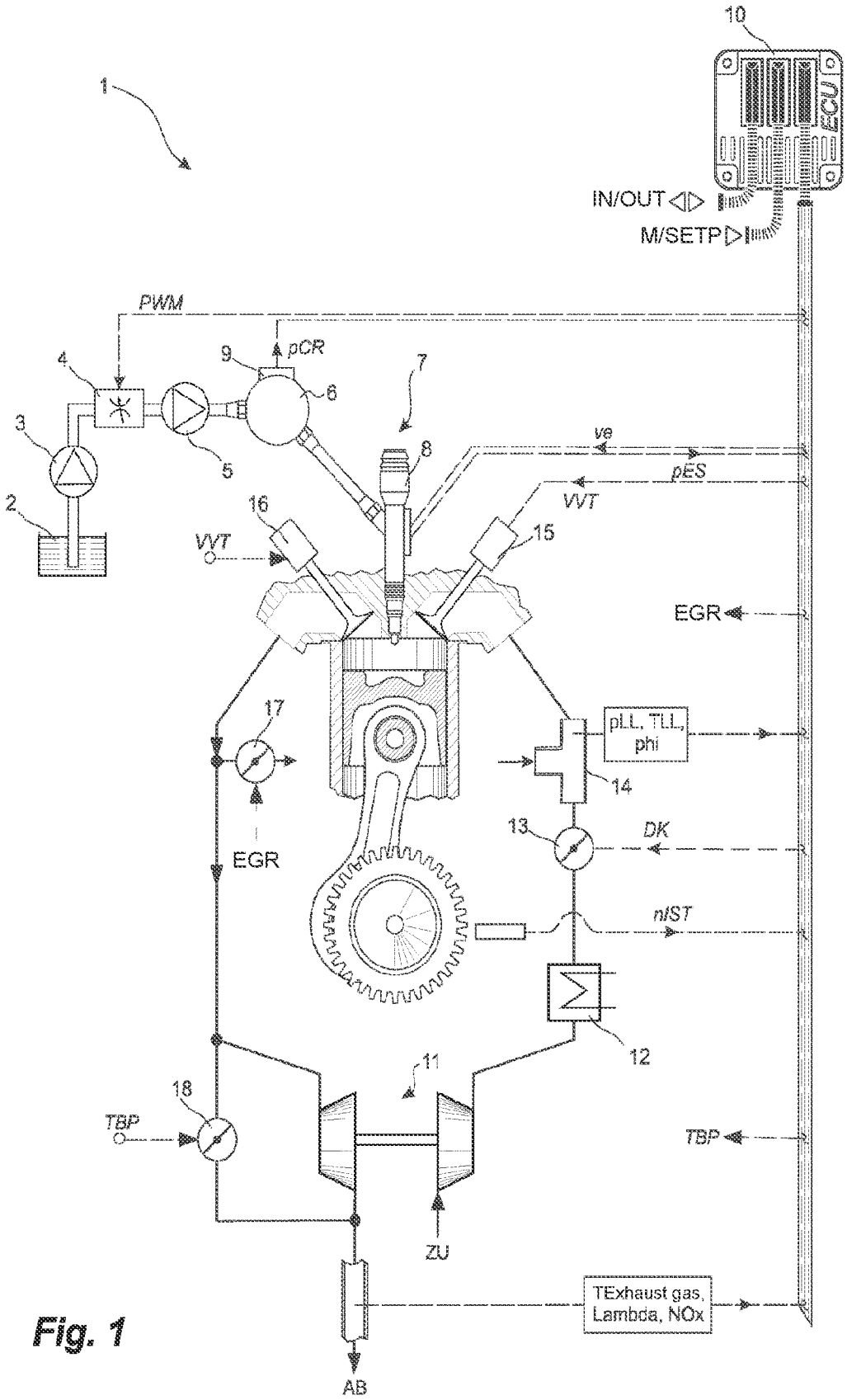
FIG. 1 shows a system diagram.

FIG. 1 shows a system diagram of an electronically controlled internal combustion engine 1 including a common rail system. The common rail system includes the following mechanical components: a low-pressure pump 3 for conveying fuel from a fuel tank 2, a changeable suction throttle 4 for influencing the fuel volumetric flow flowing through, a high-pressure pump 5 for conveying the fuel under increased pressure, a rail 6 for storing the fuel, and injectors 7 for injecting the fuel into the combustion chambers of the internal combustion engine 1. The common rail system may also optionally be embodied with individual stores, wherein an individual store 8 is then integrated as additional buffer volume, for example, in injector 7. The further functionality of the common rail system is assumed to be known. The represented gas path includes both the air supply and the exhaust gas discharge. Situated in the air supply are: the compressor of an exhaust gas turbocharger 11; a charge air cooler 12; a throttle 13; an entry point 14 for combining the charge air with the recirculated exhaust gas; and a variably activatable inlet valve 15. Situated in the exhaust gas discharge are: a variably activatable outlet valve 16; and EGR actuator 17; turbine of exhaust gas turbocharger 11; and a turbine bypass valve 18.

The mode of operation of internal combustion engine 1 is determined by an electronic control unit 10 (ECU). Electronic control unit 10 contains the usual components of a microcomputer system, for example, a microprocessor, I/O components, buffers and memory components (EEPROM, RAM). The operating data, which are relevant for the operation of internal combustion engine 1, are applied as models in the memory components. Via these models, electronic control unit 10 calculates the output variables from the input variables. The following input variables are represented by way of example in FIG. 1: a set torque M(SETP), which is predefined by an operator; the actual rail pressure pCR which is measured by way of a rail pressure sensor 9; the engine rotational speed nACT; the charge air pressure pCA; the charge air temperature TCA; the humidity phi of the charge air; the exhaust gas temperature TExhaust gas; the air/fuel ratio lambda; the NOx actual value; optionally, the pressure pES of the individual store 8; and an input variable IN. The further sensor signals not represented, for example, the coolant temperatures, are combined as the input variable IN. Represented in FIG. 1 as output variables of electronic control unit 10 are: a signal PWM for activating suction throttle 4; a signal ye for activating injectors 7 (start of injection/end of injection); a control signal DK for activating throttle 13; a control signal VVC for activating the inlet valves and outlet valves; a control signal EGR for activating EGR actuator 17; a control signal TBP for activating turbine bypass valve 18; and an output variable OUT. The output variable OUT is representative of further control signals for open-loop and closed-loop controlling internal combustion engine 1, for example, for a control signal for activating a second exhaust gas turbocharger in the case of sequential turbocharging. In the representation of FIG. 1, for example, throttle 13, EGR actuator 17, turbine bypass valve 18 or suction throttle 4 are activatable using a continuous control signal and are therefore adjustable in a continuous value range. A discrete manipulated variable on the other hand would be the control signal for activating a second exhaust gas turbocharger, since this control signal is able to accept only single discrete values; intermediate values, therefore, do not exist.

Figure 2:
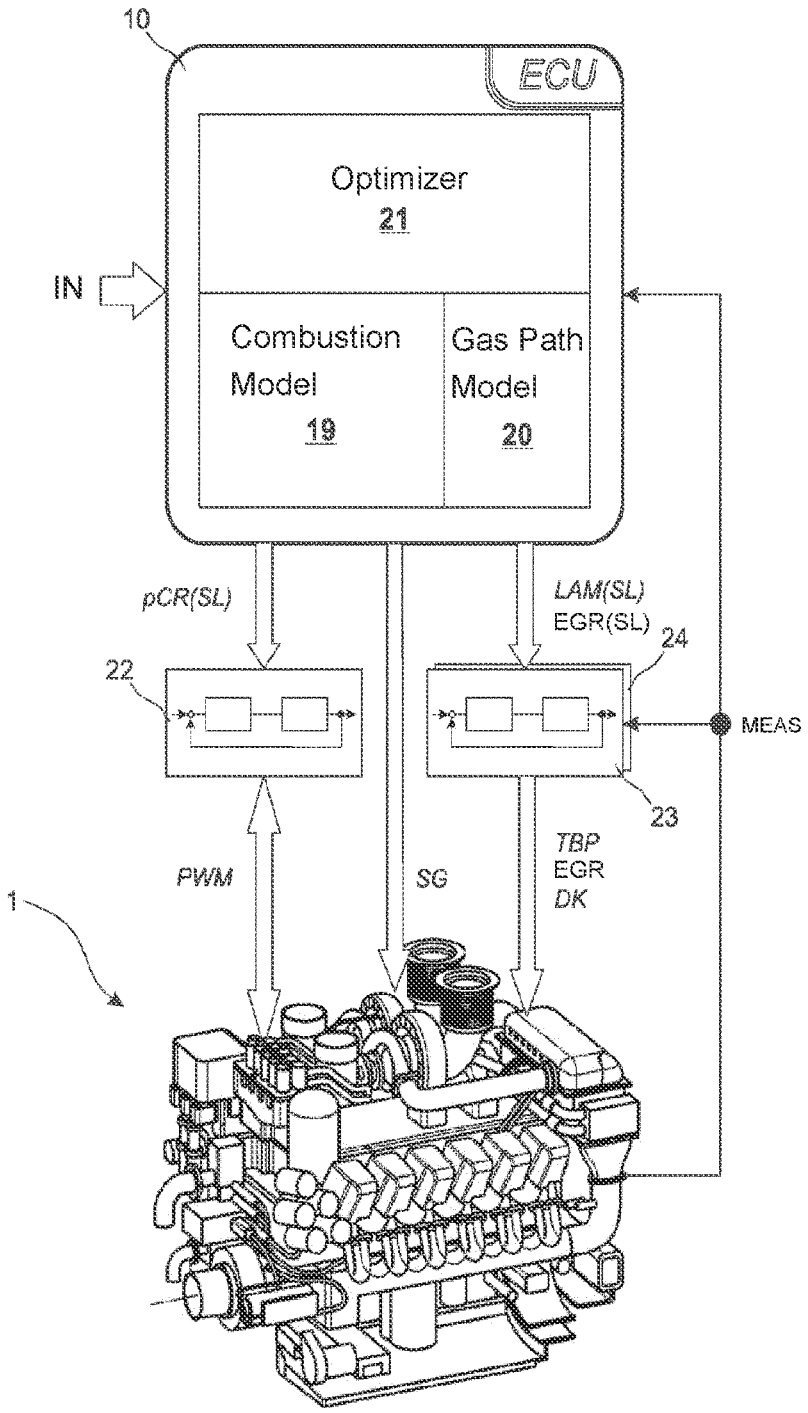
FIG. 2 shows a model-based system diagram.

FIG. 2 shows a model-based system diagram. In this representation, a combustion model 19, a gas path model 20 and an optimizer 21 are listed within electronic control unit 10. Both combustion model 19 as well as gas path model 20 map the system characteristics of the internal combustion engine as mathematical equations, for example in the form of Gaussian process models. Combustion model 19 statically maps the processes during combustion. By contrast, gas path model 20 also maps the dynamic characteristics of the air guidance and the exhaust gas guidance. Combustion model 19 contains individual models, for example, for NOx and soot generation, for the exhaust gas temperature, for the exhaust gas mass flow and for the peak pressure. These individual models in turn depend on the framework conditions in the cylinder and on the injection parameters. Combustion model 19 is determined in the case of a reference internal combustion engine in a test stand run, the so-called DoE test stand run (DoE: Design of Experiments). In the DoE test stand run, operating parameters and manipulated variables are varied systematically with the aim of mapping the overall characteristics of the internal combustion engine as a function of engine variables and environmental boundary conditions. Optimizer 21 evaluates combustion model 19, specifically, with respect to the setpoint torque M(SETP), the emission limit values, the environmental boundary conditions, for example, the humidity phi of the charge air, and the operating situation of the internal combustion engine. The operating situation is defined by the engine rotational speed nACT, the charge air temperature TCA, the charge air pressure pCA, etc. The function of optimizer 21 now consists in assessing the injection system setpoint values for activating the injection system actuators and the gas path setpoint values for activating the gas path actuators. For this purpose, optimizer 21 selects the solution in which a quality measure is minimized. The quality measure is calculated as an integral of the quadratic setpoint/actual deviations within the prediction horizon. For example, in the form:

$$J=\int[w1(NOx(\mathrm{SET}P)-NOx(\mathrm{ACT})]^2+[w2(M(\mathrm{SET}P)-M(\mathrm{ACT}))]^2+[w3(\ldots)]+ \quad (1)$$

Here, w1, w2 and w3 signify a corresponding weighting factor. The nitrogen oxide emission are known to be derived from humidity phi of the charge air, the charge air temperature TCA, the start of injection SI and the rail pressure pCR.

The best possible quality measure is ascertained by optimizer 21 via minimum finding by calculating a first quality measure at a first point in time, by varying the injection system setpoint values and the gas path setpoint values and, on the basis of these values, by predicting a second quality measure within the prediction horizon. Based on the difference between the two quality measures, optimizer 21 then establishes a minimum quality measure and sets this measure as critical for the internal combustion engine. For the example shown in the figure, it is the setpoint rail pressure pCR(SL) for the injection system. The setpoint rail pressure pCR(SL) is the guide variable for the secondary rail pressure control loop 22. The manipulated variable of rail pressure control loop 22 corresponds to the PWM signal to be applied on the suction throttle. Optimizer 21 indirectly determines the gas path setpoint values for the gas path. In the example shown, these are a lambda setpoint value LAM(SL) and an EGR setpoint value EGR(SL) as a pre-setting for the two secondary control loops 23 and 24. The recirculated measurement variables MEAS are input by electronic control unit 10. The measurement variables MEAS are understood to mean both directly measured physical variables and auxiliary variables calculated therefrom. In the example shown, lambda actual value LAM(ACT) and EGR actual value EGR(ACT) are input. The manipulated variables of the internal combustion engine are combined under reference numeral SG. This includes both the continuous manipulated variables having a continuous settings range as well as the discrete manipulated variables having discrete settings. Continuous manipulated variables may be continuously adjusted between a minimum and maximum value, for example, the start of injection and the end of injection, which are directly applied on the injector (FIG. 1: 7). Discrete manipulated variables having discrete settings may be set only in steps in fixed values, for example, a cylinder deactivation.

Figure 3:
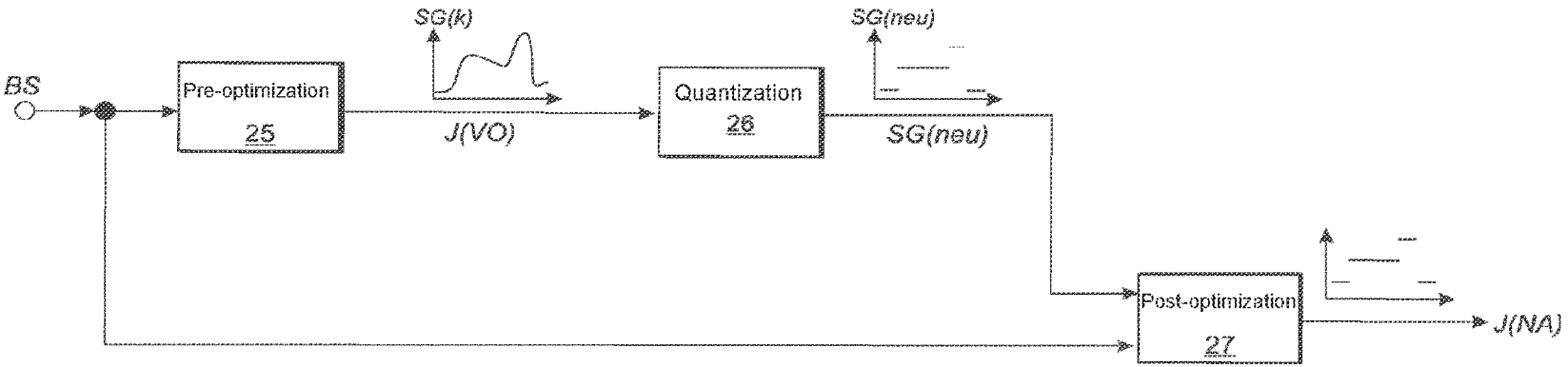
FIG. 3 shows a block diagram.

FIG. 3 shows a block diagram including the operating situation OS of the internal combustion engine as an input variable and the quality measure as an output variable, referred to here as a post-optimized quality measure J(POST). A pre-optimization 25, a quantization 26 and a post-optimization 27 are represented in the block diagram. In a first step, a pre-optimized quality measure J(PRE) is calculated via pre-optimization 25, in which the discrete manipulated variables having discrete settings are interpreted as continuous manipulated variables having a continuous settings range. One example of a discrete manipulated variable is the pre-injection, which can only be activated or deactivated. By using the pre-injection, it is possible to significantly lower the peak pressure of the combustion. In addition, however, all other combustion variables such as, for example, the NOx emission or the number of particles, also change in case of activated pre-injection. The internal combustion engine is measured once with activated pre-injection and once with deactivated pre-injection. This results in two separate combustion models. In the calculation of the pre-optimized quality measure J(PRE), intermediate values are interpolated by the optimizer; this means that as a result of the interpolation between these two combustion models, the state of pre-injection activated or deactivated is artificially transformed into a continuous input variable. This variable is then continuously used in pre-optimization 25. In FIG. 3, these continuous manipulated variables are referred to as SG(c). The pre-optimized quality measure J(PRE) is a purely internal operand, which has no access to the actuators of the internal combustion engine. In other words: the pre-optimized quality measure J(PRE) is access-free and is not connected to the internal combustion engine. In a second step, new discrete manipulated variables SG(new) are calculated from the continuous manipulated variables SG(c) via quantization 26. For the pre-injection, therefore, a fixed correlation with pre-injection activated or pre-injection deactivated is again carried out in the quantization. Quantization 26 offers the advantage that, for example, the variable valve control is fixed at three discrete values, namely minimum, mean value and maximum, for example, crankshaft angles of 450°, 495° and 540°. This reduces the computing effort in the subsequent determination of the post-optimized quality measure to a considerable extent. In addition, the calculated values are stabilized in quantization 26 via optional hysteresis bands. In a third step, the new discrete manipulated variables SG(new) and the operating situation are combined and a post-optimized quality measure J(POST) is calculated by the optimizer. In the calculation of the post-optimized quality measure J(POST), the new discrete manipulated variables SG(new) are not changed. In this respect, these variables are not a degree of freedom in the calculation of the post-optimized quality measure J(POST). In the post-optimization, the actually continuous manipulated variables are adapted to the profile, for example, of the pre-injection predefined based on the quantization. In other words: In the post-optimization, the manipulated variables, which are also actually described by continuous manipulated variables, are varied. The post-optimized quality measure J(POST) corresponds to the minimal quality measure J(min), which is set by the optimizer as critical for the operating point of the internal combustion engine (1), i.e., is connected to the internal combustion engine.

Figure 4:
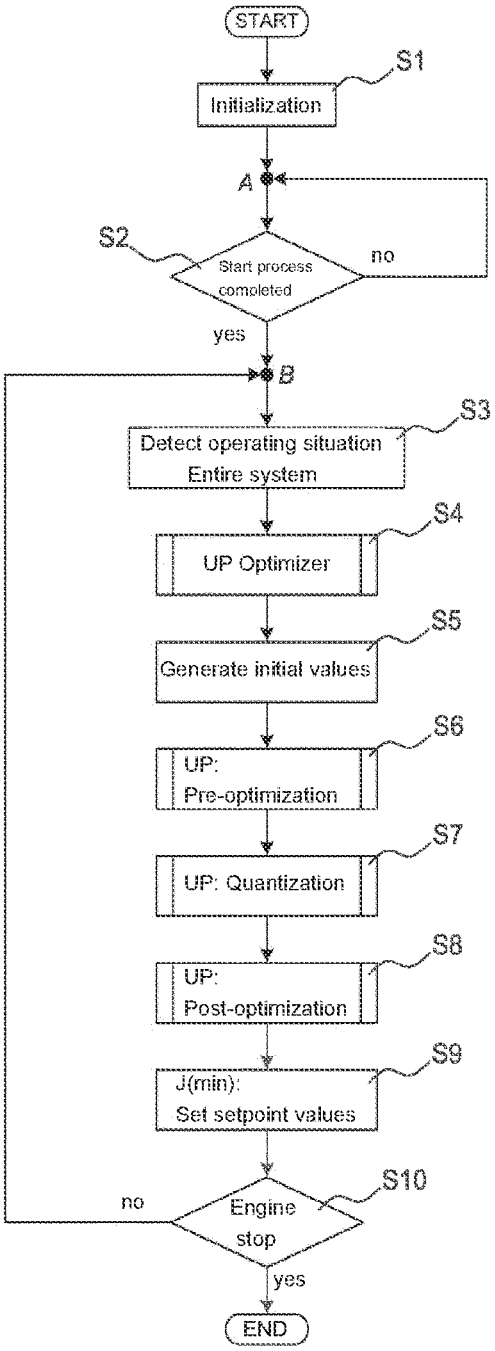
FIG. 4 shows a program flowchart.

In FIG. 4, the method is represented in a program flowchart. After the initialization at S1, it is checked at S2 whether the start process is completed. If the latter is still running, query result S2: no, return to point A. If the start process is completed, then the operating situation of the internal combustion engine is detected at S3. The operating situation is defined by the engine rotational speed nACT, the charge air temperature TCA, the charge air pressure pCA, etc. At S4, the subprogram optimizer is called up and the initial values, for example, the start of injection, are generated at S5. At steps S6 through S8, the subprograms pre-optimization, quantization and post-optimization are loaded in succession. These subprograms are described in conjunction with FIGS. 5 through 7. The quality measure calculated in the subprogram post-optimization is set as the minimized quality measure J(min), which determines the operating point of the internal combustion engine. Subsequently, it is checked at S10 whether an engine stop has been initiated. If this is not the case, query result S10: no, return to point B. Otherwise, the program flowchart is completed.

Figure 5:
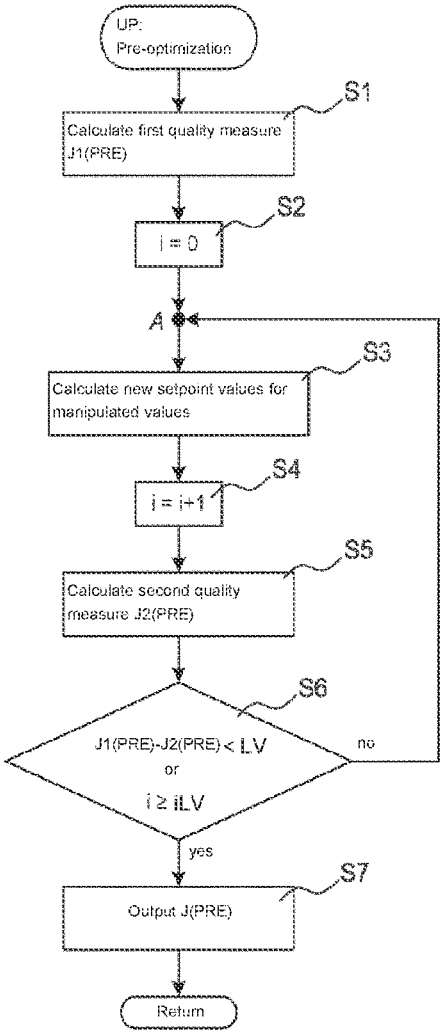
FIG. 5 shows a subprogram.

In FIG. 5, the subprogram pre-optimization is represented as a program flowchart. At S1, a first quality measure J1(PRE) of the pre-optimization is calculated based on the equation (1). An essential feature in this case is that in the calculation of the first quality measure J1(PRE), in addition to the continuous manipulated variables having a continuous settings range, the discrete manipulated variables having discrete values are interpreted as continuous manipulated variables via interpolation. At S2, a run variable i is set to zero. At S3, the initial values are subsequently changed and calculated as new setpoint values for the manipulated variables. At S4, the run variable i is increased by one. At S5, a second quality measure J2(PRE) of the pre-optimization is then predicted within the prediction horizon, for example, for the next 8 seconds, based on the new setpoint values. At S6, the second quality measure J2(PRE) is subtracted from the first quality measure J1(PRE) and compared with a limit value LV. The further progression of the quality measure is checked via difference formation of the two quality measures. Alternatively, it is checked based on the comparison of the run variables i with a limit value iLV how often an optimization has already been run. In this respect, the two limit value considerations are an abort criterion for a further optimization. If a further optimization is possible, query result S6: no, return to point A. Otherwise, at S7, the second quality measure J2(PRE) is output as pre-optimized quality measure J(PRE) together with the manipulated variables calculated in the process by the optimizer, then returning to the main program of FIG. 4. The pre-optimized quality measure J(PRE) is a pure operand, i.e., the calculated injection system setpoint values, the calculated gas path setpoint values, and the calculated manipulated variables are not connected to the internal combustion engine by the optimizer.

Figure 6:
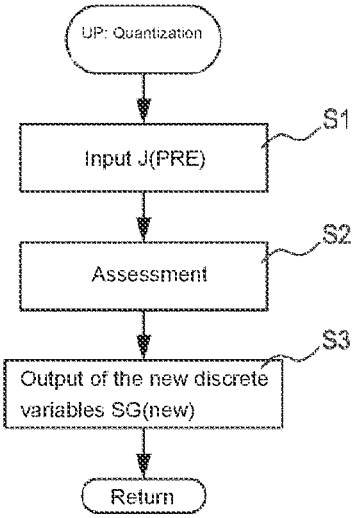
FIG. 6 shows a subprogram.

The subprogram quantization is represented in FIG. 6. At S1, the pre-optimized quality measure J(PRE) having the associated manipulated variables is input. Those manipulated variables having original discrete settings are then discretized. This takes place at S2 based on corresponding threshold values with a hysteresis band. Using this hysteresis band, avoids swinging calculation values. Instead of a hysteresis band, other logics may also be used, which prevent a rapid switch-over, for example, a time control. At S3, the new discrete manipulated variables SG(new) are then output, then returning to the main program of FIG. 4.

Figure 7:
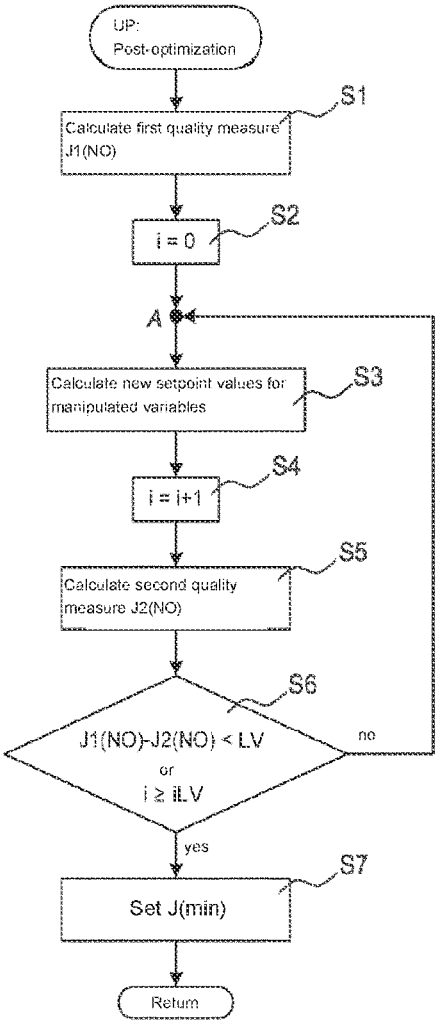
FIG. 7 shows a subprogram.

In FIG. 7, the subprogram post-optimization is represented as a program flowchart. Via the subprogram post-optimization, a post-optimized quality measure is determined from the operating situation of the internal combustion engine and the new discrete manipulated variables SG(new). The new discrete manipulated variables are not updated in the calculation of the post-optimized quality measure. At S1, a first quality measure J1(POST) of the post-optimization is calculated based on the equation (1). At S2, a run variable i is set to zero. At S3, the initial values are subsequently changed and calculated as new setpoint values for the manipulated variables. At S4, the run variable i is increased by 1. At S5, a second quality measure J2(POST) of the post-optimization is then predicted within the prediction horizon, for example, for the next 8 seconds, based on the new setpoint values. At S6, the second quality measure J2(PRE) is subtracted from the first quality measure J1(PRE) and compared with a limit value LV. The further progression of the quality measure is checked via the difference formation of the two quality measures. Alternatively, it is checked based on the comparison of the run variables I with a limit value iLV how often an optimization has already been run. In this respect, the two limit value considerations are an abort criterion for a further optimization. If a further optimization is possible, query result S6: no, then return to point A. Otherwise the second quality measure J2(PRE) is output as the minimum quality measure J(min) by the optimizer at S7, then returning to the main program of FIG. 4.

Figure 8:
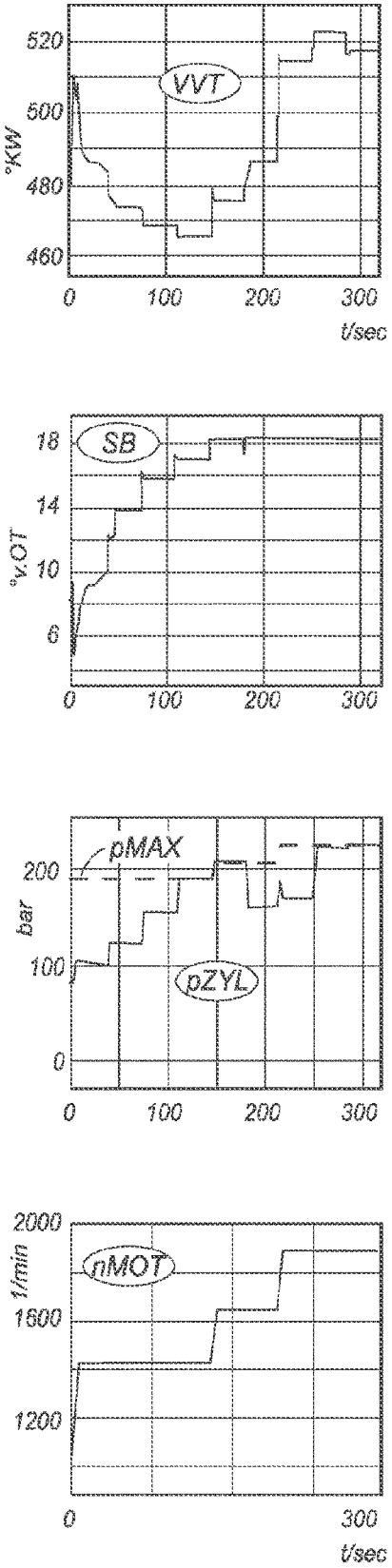
FIG. 8 shows time diagrams.
Figure 9:
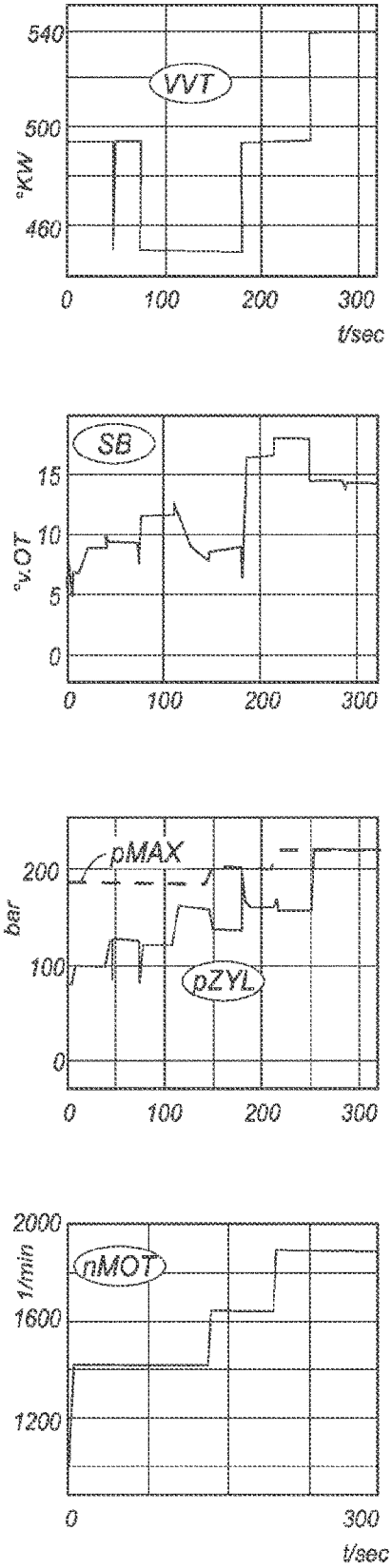
FIG. 9 shows time diagrams.

The two FIGS. 8 and 9 show in a comparison the profile of selected variables over time in seconds. Variables represented are: the variable valve control VVC in degrees of crankshaft angle; the start of injection SI in degrees before the top dead center (TDC); the combustion pressure pCYL in the cylinder; and the engine rotational speed nERS. For the combustion pressure pCYL, the maximum allowable combustion pressure pMAX is also drawn as a dashed line. These variables, when applying the previous optimization, are represented on the left side of the drawing sheet, whereas these variables, when applying the invention, are represented on the right side of the drawing sheet. The representation of FIG. 8 and of FIG. 9 is based on a stepwise increasing setpoint torque as the input variable. The variables according to FIG. 8 are described first. In a first step, a pre-optimized quality measure is calculated via the pre-optimization by the optimizer based on the operating situation. In this calculation, the discrete manipulated variables having discrete settings are interpreted as continuous manipulated variables having a continuous settings range. For the variable valve control VVC, this results in a continuous profile with arbitrary intermediate values over the entire time span. For the VVC actuator for activating the variable valve having three defined actuator positions, however, such a profile cannot be depicted. A calculated start of injection SI and the corresponding cylinder pressure pCYL correspond to the pre-optimized quality measure. In the case of the cylinder pressure pCYL, the maximum value pMAX is stuck to. The result of the manipulated values in the period under consideration is an increasing engine rotation speed nERS. FIG. 9 is described next. The VVC profile depicted corresponds to the profile after the quantization. In this case, it becomes clear that unlike the representation of FIG. 8, the VVC profile shows only three discrete values, namely crankshaft angles of 450°, 495° and 540°. It is advantageous that the VVC actuator is able to be activated using merely three values, thereby significantly reducing the computing effort. The post-optimized quality measure is calculated from the VVC profile based on the operating situation of the internal combustion engine. The profile of the start of injection SI and the cylinder pressure pCYL which, in this case remains below the maximum value pMAX, correspond to the post-optimized quality measure.

REFERENCE NUMERALS

1 Internal combustion engine
2 Fuel tank
3 Low pressure pump
4 Suction throttle
5 High pressure pump
6 Rail
7 Injector
8 Individual store
9 Rail pressure sensor
10 Electronic control unit
11 Exhaust gas turbocharger
12 Charge air cooler
13 Throttle
14 Entry point
15 Inlet valve, variably activatable
16 Outlet valve, variably activatable
17 EGR actuator (EGR: Exhaust Gas Recirculation)
18 Turbine bypass valve
19 Combustion model
20 Gas path model
21 Optimizer
22 Rail pressure control loop
23 Lambda-control loop
24 EGR control loop
25 Pre-optimization
26 Quantization
27 Post-optimization While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method for a model-based open-loop and closed-loop control of an internal combustion engine, the method comprising the steps of:

calculating, by an optimizer, a pre-optimized quality measure based on an operating situation of the internal combustion engine, wherein, in calculating the pre-optimized quality measure, a plurality of discrete manipulated variables having a plurality of discrete settings are interpreted as a plurality of continuous manipulated variables having a continuous settings range;

quantizing the plurality of continuous manipulated variables, and the plurality of continuous manipulated variables are set as a plurality of new discrete manipulated variables (SG(new)) having a plurality of discrete settings; and calculating, by the optimizer, a post-optimized quality measure based on the plurality of new discrete manipulated variables and the operating situation of the internal combustion engine, and the post-optimized quality measure is set as critical for an operating point of the internal combustion engine by the optimizer.

2. The method according to claim 1, wherein the pre-optimized quality measure (J(PRE)) is determined by calculating a plurality of injection system setpoint values for activating a plurality of injection system actuators via a combustion model, by calculating a plurality of gas path setpoint values for activating a plurality of gas path actuators via a gas path model, and by calculating the plurality of continuous manipulated variables (SG(c)) from the discrete settings of the plurality of discrete manipulated variables via interpolation.

3. The method according to claim 2, wherein the pre-optimized quality measure (J(PRE)) is specified to be access free for a plurality of actuators of the internal combustion engine, the plurality of actuators including the plurality of injection system actuators and the plurality of gas path actuators.

4. The method according to claim 3, wherein, in the step of quantizing, the plurality of continuous manipulated variables (SG(c)) are quantized via switching thresholds in addition to hysteresis.

5. The method according to claim 1, wherein the post-optimized quality measure is determined—in the step of calculating the post-optimized quality measure by calculating a plurality of injection system setpoint values for activating a plurality of injection system actuators via a combustion model, by calculating a plurality of gas path setpoint values for activating a plurality of gas path actuators via a gas path model, and by, in a case where a plurality of the new discrete manipulated variables (SG(new)) are constant, the optimizer performing the step of calculating via a change of the plurality of injection system setpoint values and the plurality of gas path setpoint values via a minimum finding within a prediction horizon.

* * * * *